US008036068B1

(12) United States Patent
Yamagami

(10) Patent No.: US 8,036,068 B1
(45) Date of Patent: Oct. 11, 2011

(54) DIGITAL ALARM CLOCK WITH USER-SELECTABLE ALARM SOUND SOURCE INCLUDING FROM INTERNET

(75) Inventor: Rui Yamagami, San Diego, CA (US)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 12/772,420

(22) Filed: May 3, 2010

(51) Int. Cl.
*G04B 23/02* (2006.01)
*G04C 23/14* (2006.01)

(52) U.S. Cl. ..... 368/244; 368/251

(58) Field of Classification Search ..... 368/244, 368/250, 251
See application file for complete search history.

(56) References Cited

U.S. PATENT DOCUMENTS

| | | | | |
|---|---|---|---|---|
| 2002/0099550 | A1 * | 7/2002 | Emerick, Jr. | 704/270 |
| 2005/0174889 | A1 * | 8/2005 | Marcantonio et al. | 368/12 |
| 2008/0151696 | A1 * | 6/2008 | Giroud et al. | 368/10 |
| 2010/0177598 | A1 * | 7/2010 | Zhang et al. | 368/10 |
| 2010/0195447 | A1 * | 8/2010 | George | 368/13 |

OTHER PUBLICATIONS

"Alarms—Two Types of Alarms are available: Quick Alarm and Custom Alarm", http://www.chumby.com/pages/cp_alarm.
"Custom Alarm", http://www.chumby.com/pages/cp_alarm_custom.
"Step-By-Step Custom Alarm Tutorial", http://www.chumby.com/pages/cp_alarm_tut01.

* cited by examiner

*Primary Examiner* — Sean Kayes
(74) *Attorney, Agent, or Firm* — John L. Rogitz

(57) ABSTRACT

A user can select an alarm sound source from a list including, e.g., radio and Internet, and at the user-defined alarm time, audio received from the source is automatically displayed on a speaker to awaken the user.

4 Claims, 3 Drawing Sheets

DIGITAL ALARM CLOCK WITH USER-SELECTABLE ALARM SOUND SOURCE INCLUDING FROM INTERNET

I. FIELD OF THE INVENTION

The present application relates generally to digital alarm clocks with user-selectable sound sources, including sources on the Internet.

II. BACKGROUND OF THE INVENTION

A wide variety of CE devices such as wireless telephones, digital clocks, etc. have been provided that leverage digital processing to provide a multiplicity of useful features to users. The present application understands that a device such as a digital clock may be further enhanced by enabling a user to determine a source of sound for the alarm feature of the clock, so that the alarm sound is tailored to the user's own personal preferences.

SUMMARY OF THE INVENTION

Accordingly, a digital alarm clock includes a housing, a processor in the housing, and a speaker on the housing and controlled by the processor. An Internet interface is also on the housing in communication with the processor. The processor receives a user time input designated by the user as a future alarm time, and responsive to the future alarm time, the processor accesses an Internet site through the Internet interface and presents audio therefrom on the speaker automatically at the future alarm time.

If desired a visual display may be on the housing. The processor can control the visual display to present a visible indication of the Internet site at the alarm time. The visual display may be a touchscreen display, and the user time input can be received from the touchscreen display.

In some embodiments the processor presents a user interface (UI) on the visual display including a "set alarm" selector element selectable by a user to enter an alarm settings mode, in which a user can establish the future alarm time and a source of sound therefor. Also, a UI can be presented allowing a user to select as the source of sound, in addition to selecting the Internet site, a radio station, and/or a disk player, and/or a TV channel.

In another aspect, an apparatus includes a processor, a display controlled by the processor, a speaker, and a tangible computer readable storage medium bearing instructions to cause the processor to present on the display a UI listing alarm sound sources. At least two of the sources are Internet and radio. The processor receives user selection of an alarm sound source and at a user-defined alarm time, displays audio received from the alarm sound source on the speaker.

In another aspect, a method includes receiving, at a digital processor, a user selection of an alarm time. The method also includes receiving at the processor a user selection of an alarm sound source from a group of sources including the Internet, and at the alarm time, displaying on an audio speaker audio received from the alarm sound source automatically.

The details of the present invention, both as to its structure and operation, can best be understood in reference to the accompanying drawings, in which like reference numerals refer to like parts, and in which:

DETAILED DESCRIPTION OF THE PREFERRED EMBODIMENT

Figure 1:
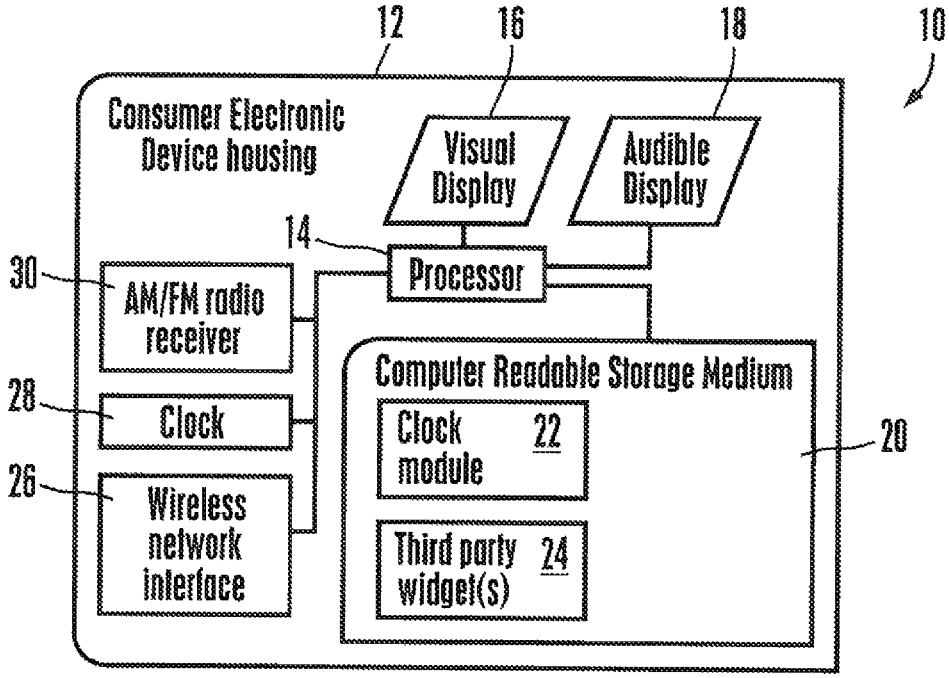
FIG. 1 is a block diagram of an example system in accordance with present principles.

Referring initially to FIG. 1, a CE device 10 is shown that includes a typically portable lightweight plastic housing 12 bearing a digital processor 14. The processor 14 can control a visual display 16 and an audible display 18 such as one or more speakers. The visual display 16 may be, e.g., a capacitive touchscreen display, although other display types may be used.

To undertake present principles, the processor 14 may access one or more computer readable storage media 20 such as but not limited to disk-based or solid state storage. In example non-limiting embodiments, the media 20 may store various software modules, including, for example, a clock module 22 for presenting a visual indication of time on the display 16, and one or more widgets 24 that may be provided by third parties and/or by the manufacturer of the CE device. By "widget" is meant a portable module of computer software that can be installed and executed within, for example, a HTML-based web page by an end user without requiring compilation. Widgets can take the form of on-screen tools (such as, e.g., clocks, event countdowns, auction-tickers, stock market tickers, flight arrival information, daily weather etc).

If desired, a network interface such as but not limited to a wireless network interface 26 may be in the housing 12 and may communicate with the processor 14 to permit the processor 14 to communicate with a wide area computer network such as the Internet. The interface 46 may be, without limitation, a WiFi interface. Also, a computer clock 28 can be supported in the device and can communicate time of day information to the processor. An AM/FM radio receiver 30 may be in the housing along with, if desired, a TV receiver.

FIGS. 2-7 show various UI that can be used to establish various example settings described further below. Movement between UIs can be effected by taps on the display 16 or on the housing if the device is provided with a motion sensor such as an accelerometer. As shown in FIGS. 2-7, in the preferred embodiment all UIs display current time, date, day of week at 32, a manufacturer logo at 34 or some other logo such as the logo of a hotel in which the device is used, and a current widget at 36. Other windows 38 may be provided for displaying standard information across all UIs.

Figure 2:
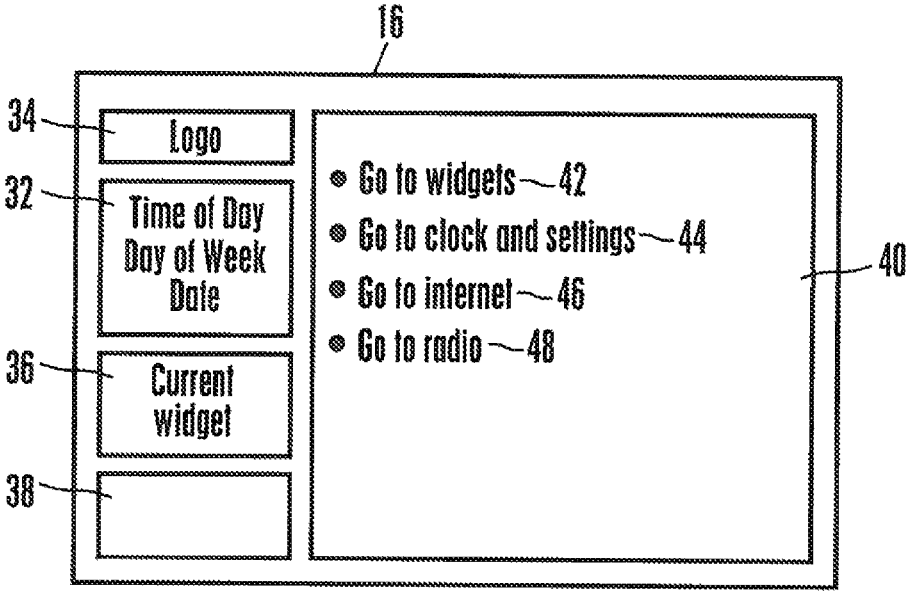
FIGS. 2-7 are screen shots illustrating user interfaces (UI) which may be used to establish various device settings, including alarm clock sound source.

FIG. 2 illustrates that a main UI 40 window is provided in which selector elements may be displayed so that a user can select an element and establish a setting thereby or, in the case of the UI 40 of FIG. 2, enter a lower-level UI. In the non-limiting example of FIG. 2, the user may select, by appropriately touching the respective selector elements 42, 44, 46, 48, to go to a widgets screen, a clock setting screen, an Internet screen, and a radio screen.

Figure 3:
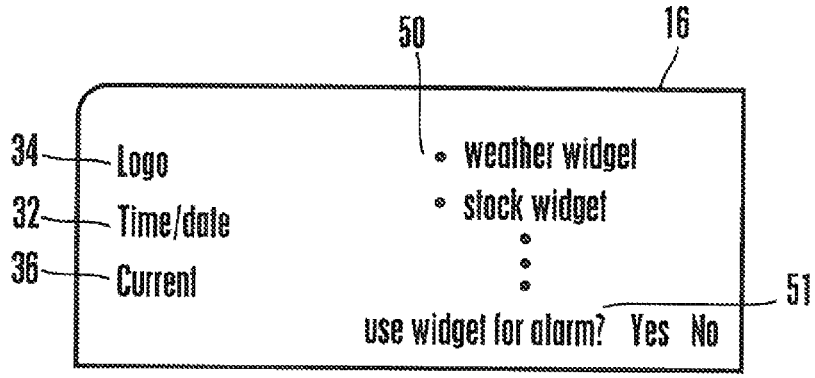

FIG. 3 shows that a widget UI 50 may be presented on the display 16 in response to selection of the widget element 42 in FIG. 2. As shown, the widget UI 50 presents a list of widgets that may selected by touching an element on the list to cause the widget to be presented in, e.g., the current widget window 36 of FIG. 2. Also, the user can touch the appropriate "yes" or "no" selection to respond to the prompt 51 "use widget for alarm?" If "Y" is selected, at the alarm time the processor will cause the speaker 18 to display audio from the selected widget.

Figure 4:
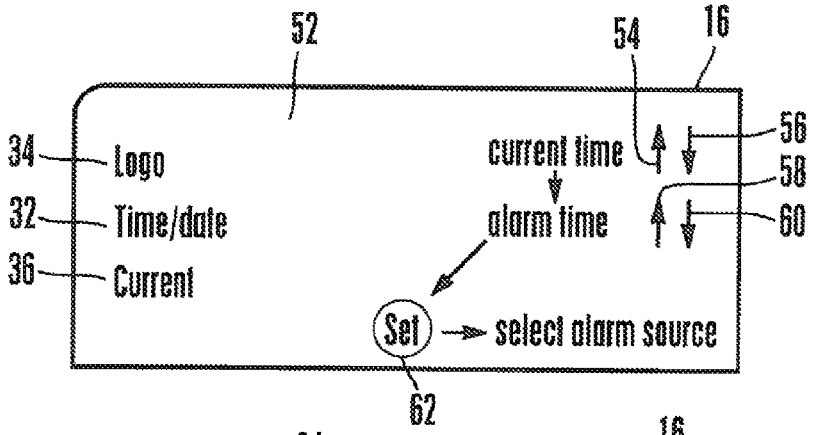

FIG. 4 shows that a clock settings UI 52 may be presented on the display 16 in response to selection of the clock element 44 in FIG. 2. As shown, the clock settings UI 52 presents forward and backward selector elements 54, 56 that can be touched to move forward or move back, respectively, the current time displayed by the device. Similarly, the clock settings UI 52 presents forward and backward selector elements 58, 60 that can be touched to move forward or move back, respectively, the future alarm time desired by the user. Additionally, the UI 52 may present a select alarm source element 62 that if touched can invoke the UI described further below in reference to FIG. 7 to enable a user to select which source should provide audio at the alarm time to the speakers 18.

Figure 5:
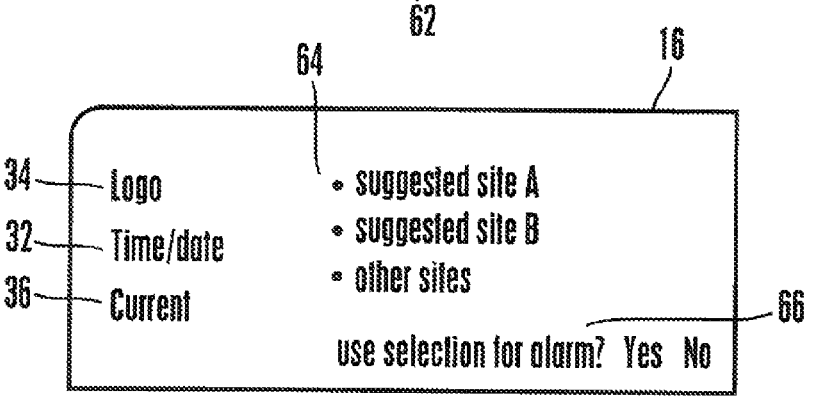

FIG. 5 shows that an Internet UI 64 may be presented on the display 16 in response to selection of the Internet element 46 in FIG. 2. As shown, the Internet UI 64 presents a list of Internet sites that may selected by touching an element on the list to cause a page from the selected site to be presented in, e.g., the window 38 of FIG. 2. Also, the user can touch the appropriate "yes" or "no" selection to respond to the prompt 66 "use selection for alarm?" If "Y" is selected, at the alarm time the processor will cause the speaker 18 to display audio from the selected Internet site.

Figure 6:
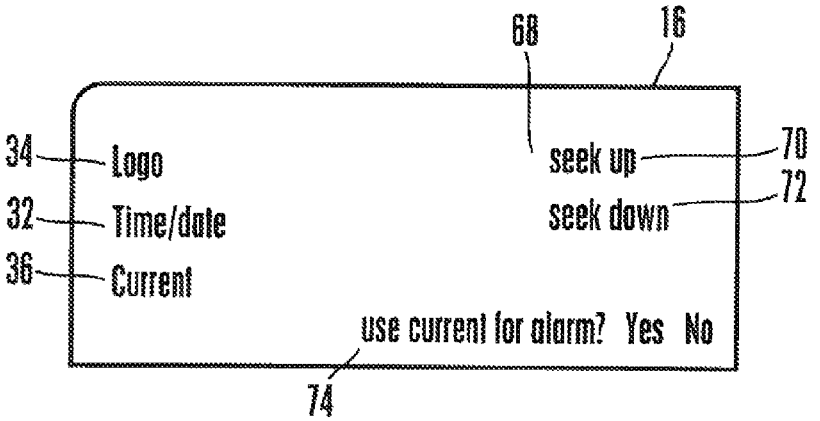

FIG. 6 shows that a radio UI 68 may be presented on the display 16 in response to selection of the radio element 48 in FIG. 2. As shown, the radio UI 68 can provide a "seek up" selector element 70 which, if touched, causes the radio to tune to the next higher station received by the radio receiver 30, as well as a "seek down" selector element 72 which, if touched, causes the radio to tune to the next lower station received by the radio receiver 30. The radio UI 68 can present alternative station selector elements, e.g., a virtual knob that a user can move his finger against to cause the processor to "tune" the radio receiver 30 up/down, or a list of available stations, etc.

Additionally, the user can touch the appropriate "yes" or "no" selection to respond to the prompt 74 "use current for alarm?" If "Y" is selected, at the alarm time the processor will cause the speaker 18 to display audio from the currently tuned-to station. Alternatively, the processor may cause the speaker 18 to display audio from whatever station happens to be tuned to at the alarm time.

Figure 7:
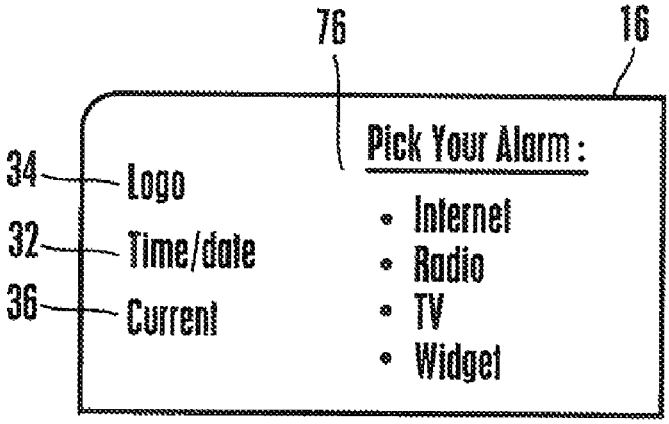

As mentioned above, selection of the element 62 from FIG. 4 can cause an alarm source selection UI 76 of FIG. 7 to appear, in which a list of alarm audio sources is presented for selection of one of the sources by the user. The selected source will be used as the audio that is displayed on the speakers 18 at alarm time. It may now be appreciated that the alarm sound source may be selected from one of the specific source UIs of FIGS. 3, 5, and 6 or from the alarm source selection UI 76 of FIG. 7.

Figure 8:
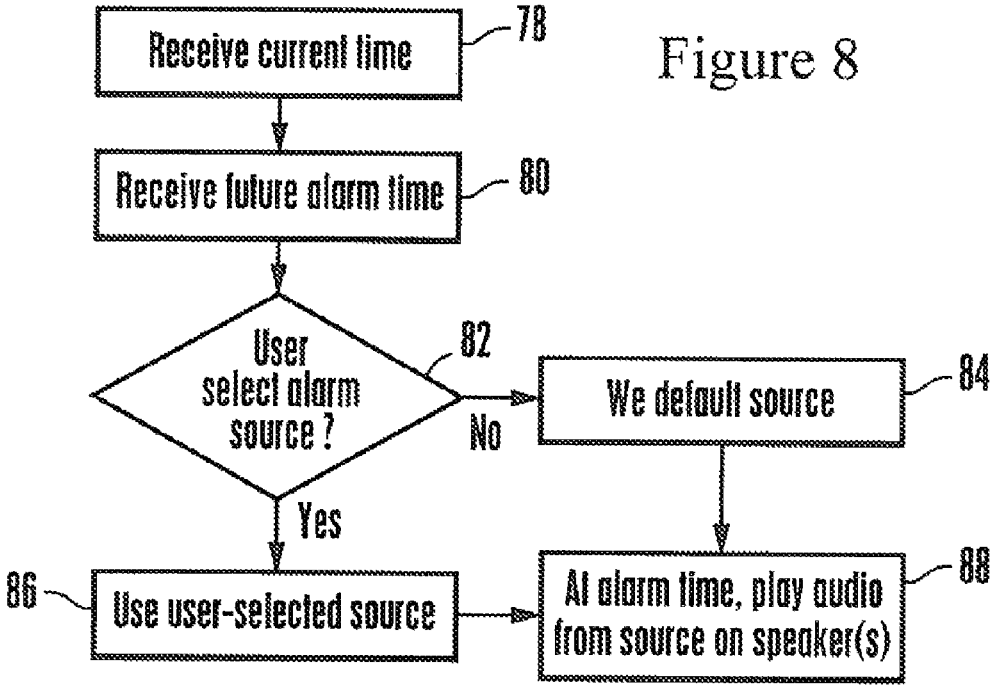
FIG. 8 is a flow chart of example logic for alarming at the user-set time using the user-defined source.

With the above description in mind, the logic of FIG. 8 can be appreciated. Commencing at block 78, the processor receives the current time from the internal clock. Also, the processor receives the future alarm time setting at block 80 using principles disclosed above. Decision diamond 82 simply indicates that if the user has not selected an alarm sound source using any of the methods described previously, then a default source (e.g., the radio 30) is designated as the alarm sound source at block 84. However, if the user has selected one of the above-described sources then the user-selected source is designated as the alarm sound source at block 86. When the processor determines that the future alarm time has arrived (i.e., equals the current time presented on the display), at block 88 the processor causes audio from the selected source to be displayed on the speakers 18.

While the particular DIGITAL ALARM CLOCK WITH USER-SELECTABLE ALARM SOUND SOURCE INCLUDING FROM INTERNET is herein shown and described in detail, it is to be understood that the subject matter which is encompassed by the present invention is limited only by the claims.

What is claimed is:

1. Digital alarm clock comprising:

housing supporting a visual display;

processor in the housing;

at least one speaker on the housing and controlled by the processor;

Internet interface on the housing communicating with the processor;

the processor receiving a user time input designated by the user as a future alarm time, and responsive to the future alarm time, the processor accesses an Internet site through the Internet interface and presents audio therefrom on the speaker automatically at the future alarm tithe, wherein the processor presents on the display:

a main user interface (UI) having plural selector elements selectable by a user to establish a setting of the clock thereby, at least some selector elements being selectable to enter respective lower-level UIs including a widgets UI, a clock setting UI, an Internet UI, and a radio UI, wherein the widget UI is presented on the display in response to selection of a widget selector element of the main UI, the widget UI presenting a list of widgets selectable by touching an element on the list to cause the widget to be presented in a current widget window of the main UI, the widget UI enabling a user to select to use a widget as an audio source for an alarm;

the clock settings UI is presented on the display in response to selection of a clock selector element of the main UI, the clock settings UI presenting forward and backward time selector elements selectable to move forward or move back, respectively, a current time presented on the display, the clock settings UI presenting forward and backward alarm selector elements selectable to move forward or move back, respectively, a future alarm time desired by the user, the clock setting UI presenting a select alarm source element selectable to invoke a UI enabling a user to select which source should provide audio at an alarm time;

the Internet UI is presented on the display in response to selection of an Internet selector element of the main UI, the Internet UI-presenting a list of Internet sites selectable to cause a page from a selected site to be presented on the main UI, the Internet UI enabling a user to select to play audio from an Internet site at an alarm time;

the radio UI is presented on the display in response to selection of a radio selector element of the main UI, the radio UI including "seek up" selector element which, if selected, causes the clock to tune to a next higher station received by a radio receiver in the clock and a "seek down" selector element which, if selected, causes the clock to tune to a next lower station received by the radio receiver;

wherein selection of a source selector element of the clock settings UI invokes for display an alarm source selection UI presenting a list of alarm audio sources for selection of one of the sources by the user to be used as an audio source that is played on the speaker at alarm time, such that an alarm sound source may be selected from the alarm source selection UI, and from the widget UI, and from the Internet UI, and from the radio UI.

2. The alarm clock of claim 1, the processor controlling the visual display to present a visible indication of the Internet site at the alarm time.

3. The alarm clock of claim 2, wherein the visual display is a touchscreen display, the user time input being received from the touchscreen display.

4. The alarm clock of claim 1, wherein a UI is presented allowing a user to select as the source of sound, in addition to selecting the Internet site, a TV channel.

* * * * *